United States Patent [19]

Hazlegrove et al.

[11] Patent Number: 4,710,059

[45] Date of Patent: Dec. 1, 1987

[54] METHOD AND APPARATUS FOR SIMULTANEOUS TRENCHING AND PIPE LAYING IN AN ARCTIC ENVIRONMENT

[75] Inventors: Billy M. Hazlegrove; Richard A. Roberts, both of Houston, Tex.

[73] Assignee: Brown & Root, Inc., Houston, Tex.

[21] Appl. No.: 934,016

[22] Filed: Nov. 24, 1986

[51] Int. Cl.[4] ..... F16L 1/04

[52] U.S. Cl. ..... 405/162; 405/158; 405/168

[58] Field of Search ..... 405/154, 158, 159, 161, 405/163, 166, 168, 169; 37/58, 63

[56] References Cited

U.S. PATENT DOCUMENTS

| | | | |
|---|---|---|---|
| 3,583,170 | 6/1971 | De Vries | 405/162 |
| 3,978,679 | 9/1976 | Le Comte | 405/159 |
| 4,126,013 | 11/1978 | McGovern | 405/169 |
| 4,575,280 | 3/1986 | Hemphill et al. | 405/159 X |
| 4,616,956 | 10/1986 | Hemphill | 405/158 |

*Primary Examiner*—David H. Corbin

*Attorney, Agent, or Firm*—Lahive & Cockfield

[57] ABSTRACT

Disclosed is an apparatus for simultaneously trenching and laying a submarine pipeline within the bed of a body of water covered with a relatively thick ice mass. The apparatus comprises a pipeline construction spread which precedes a trenching and pipe installation spread, both of which traverse the ice mass. The pipe installation vehicle advances toward the constructed pipeline, elevates the pipeline, forms a slot-like opening in the ice and directs the pipeline into the water through the slot. A submersible dredging assembly extends from a installation vehicle which forms part of the installation spread. As the vehicle advances, the dredging assembly forms a trench in the sea bed. At the same time the dredging assembly guides the pipeline into the trench and provides support to a submerged component of the pipeline which is threaded through a slot in the dredging assembly.

25 Claims, 10 Drawing Figures

METHOD AND APPARATUS FOR SIMULTANEOUS TRENCHING AND PIPE LAYING IN AN ARCTIC ENVIRONMENT

BACKGROUND OF THE INVENTION

This invention relates to the laying of submarine pipelines. More particularly, the invention is directed to simultaneous trenching and pipe laying in an arctic environment.

Offshore oil production and storage facilities are typically linked to onshore facilities by at least one pipeline which has been laid upon the bed of a body of water. Because of the potential for vast offshore oil deposits in arctic regions many such pipelines will have to be constructed in bodies of water which are covered with a relatively thick ice mass for much of the year. Such pipe laying operations may take place during a winter season when the water is covered with a thick ice mass, or during a summer season when the water is open.

Arctic pipe laying operations which are restricted to the short open water season rarely provide sufficient time to lay a pipeline of appreciable length. Economic hardships are thus incurred as a result of delays in the flow of production revenues, and consequently, less opportunity for rapid installation cost reduction.

Alternatively, pipelaying operations conducted during an arctic winter season present the special problems associated with such a harsh environment. One noteworthy problem is that it is necessary to penetrate an ice mass of substantial thickness in order to gain access to the body of water in which the pipeline is to be laid. Moreover, it is often difficult to conveniently support the dredging and laying apparatus upon the ice mass or water.

There are several known techniques for arctic trenching and pipelaying. For example, U.S. Pat. Nos. 3,822,558, issued July 9, 1974, and 3,924,896, issued Dec. 9, 1975, each disclose an arctic-type pipelaying and burying arrangement. These patents disclose a buoyant platform, supported on a cushion of air, which is operable to form a slot in the ice through which ice laying and burying equipment extend. A trencher mechanism extends beneath the surface of the water from the bow end of the platform while a stinger for supporting the pipeline to be laid extends from the stern of the platform. Other arctic pipelaying arrangements are disclosed in U.S. Pat. Nos. 3,681,927, issued Aug. 8, 1972, 3,744,259, issued July 10, 1973, 3,844,129, issued Oct. 29, 1974, and 3,900,146, issued Aug. 19, 1975.

Conventional pipelaying and burying arrangements in which a pipeline or cable being laid passes through or across a trencher mechanism are disclosed in U.S. Pat. Nos. 734,615, issued July 28, 1903, 737,021, issued Aug. 25, 1903, 956,604, issued May 3, 1910, and 3,641,780, issued Feb. 15, 1972.

The methods and apparatus described in the prior art fail to provide convenient and reliable means for laying and burying pipe on the bed of a body of water covered with an ice mass. Moreover, the prior art fails to disclose a simultaneous method and apparatus for laying and burying a submarine pipeline in which the pipeline to be laid receives adequate support while submerged, but prior to being received in a trench It is accordingly a primary object of this invention to provide a reliable method and apparatus for the simultaneous trenching and laying of a submarine pipeline. Another object of the invention is to provide a method and apparatus for trenching and laying a pipeline within a seabed during an arctic winter season in which the body of water is covered with an ice mass of substantial thickness. It is also an object of this invention to provide a novel apparatus for supporting simultaneous trenching and laying operation. A further object of this invention is to provide a submersible apparatus for conducting dredging operations while providing adequate lateral support for a submerged portion of the pipe. Other objects of this invention will be apparent to those skilled in the art upon reading this disclosure.

SUMMARY OF THE INVENTION

According to this invention, a method and apparatus is provided for the simultaneous trenching and laying of pipeline within the bed of a body of water covered with a relatively thick ice mass (i.e. 6 to 8 feet) which serves as a working platform. The apparatus of this invention comprises mobile pipeline construction and installation means which advance on the ice mass over the location where the pipeline is to be laid.

The mobile means has two primary components. A first component, referred to as a pipeline construction spread, constructs an integral pipeline of an indefinite length by joining together a number of pipe segments. This spread is similar to, and utilizes similar technology, as the known cross-country and lay barge pipe construction techniques. The assembled pipeline is deposited behind the pipe construction spread on supports which maintain the constructed pipeline just above the surface of the ice.

Following immediately behind the pipe construction spread is a pipeline installation spread. The installation spread comprises a vehicle which traverses the ice mass to support and control the trenching and laying operations as well as a series of pipe elevation supports and ice cutting and removal means.

The pipe elevation support means comprise a plurality of skid-supported structures which are spaced apart and connected to each other and propelled by a tractor or similar means. These structures gradually guide the constructed pipeline to a height approximately twenty feet above the surface of the ice. Also included is a down ramp, or similar means, also supported by skids, which guides the pipe from a position of maximum height, downwardly to a position beneath the surface of the ice.

Disposed between the pipe elevation supports, and under the elevated pipeline, is an ice cutting and removal apparatus. In a preferred embodiment, this apparatus includes a first machine which forms two parallel cuts in the ice which are spaced apart by approximately 8 to 10 feet. Following behind the first cutting device is an apparatus which forms cuts in the ice perpendicular to and between the first parallel cuts, thus forming ice blocks. This apparatus also features means for gripping the ice blocks and placing them under the lip of the ice mass on alternating sides of the ice slot. In one embodiment, a third apparatus, such as a gantry crane, removes selected ice blocks for replacement in the ice slot behind the installation spread to provide added reinforcement to the ice. Preferably, each apparatus is supported by tracks or skids which straddle the ice slot and rest upon the ice mass.

The installation spread follows behind the pipeline elevation system and includes a self-propelled lightweight vehicle. The vehicle is supported on and propelled over the ice by crawler tracks which straddle the slot in the ice. The installation spread is also equipped with a dredging assembly which facilitates the formation of a trench in the sea bed and aids in laying the constructed pipeline within the trench. As the installation spread advances toward the assembled pipeline, the length of the trench is advanced by continued dredging. This advancement also results in the constructed pipeline being received by the installation vehicle and simultaneously laid within the formed trench. In a preferred embodiment the spoils of the dredging operation are directed into a discharge pipe and diverted back into the trench to bury the laid pipeline.

In a preferred embodiment the dredging means, such as a cutter suction head, is appended to the installation vehicle by way of a support means such as a dredging ladder. One end of the dredging ladder is pivotally secured to the installation spread, and from this point of attachment the dredging ladder extends forwardly at a slight angle beneath the surface of the water. The submerged end of the dredging ladder houses the dredging means which includes a cutter suction head, a dredging motor and dredging pump. In addition, a discharge pipe extends backwardly from the pump of the dredging means toward the trench.

The dredging ladder is movable between a non-operative position directly below and substantially parallel to the longitudinal axis of the platform, and an operative position in which it is disposed beneath the surface of the water. An actuable arm may extend from the vehicle to an intermediate location on the dredging ladder to aid in the raising and lowering of the dredging ladder. The dredging ladder features a centrally disposed slot which is intended to receive and provide sub-sea support to the pipeline to be laid. Preferably, the dredging ladder supports the submerged pipeline at a critical location between the midpoint of the submerged component of the pipeline and the surface of the water.

In a preferred embodiment, power is supplied to both the pipe construction spread and the pipe laying spread from a remote facility (or facilities) which traverses the ice mass alongside the spreads. A power supply cord is connected between the power supply vehicle and the spreads.

Other objectives, features and advantages of this invention will be readily apparent from the following description of a preferred embodiment thereof, taken in conjunction with the accompanying drawings. It is to be understood that variations in and modifications to this invention may be effected without departing from the spirit and scope of the novel concepts of this disclosure.

DETAILED DESCRIPTION OF THE PREFERRED EMBODIMENTS

Figure 1A:
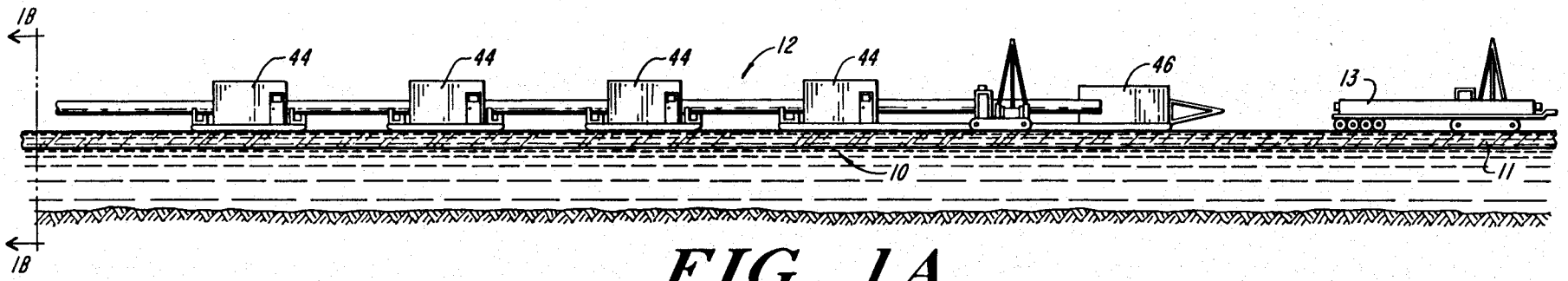
FIG. 1A is a side perspective view of the pipeline construction apparatus of this invention.
Figure 1B:
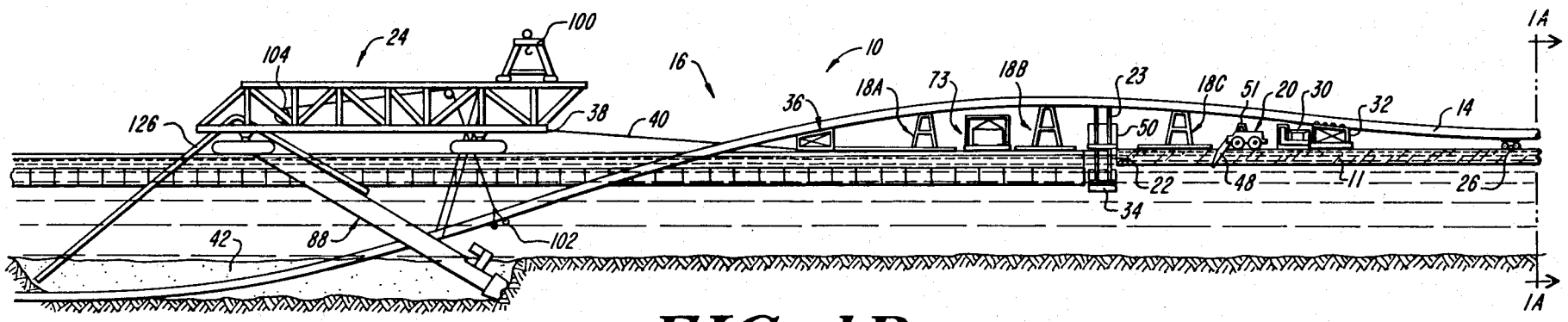
FIG. 1B is a side perspective view of the pipeline installation spread of this invention.

FIG. 1 illustrates a preferred embodiment of the present invention in which an apparatus 10 is provided for simultaneously forming a trench within the bed of a body of water covered with an ice mass 11 and laying a pipeline 14 within the trench. The apparatus 10 comprises two basic components, both of which are adapted to traverse a relatively thick ice mass covering the body of water. A pipeline construction spread 12 is provided for joining pipe segments 13 to form an integral pipeline 14 of indeterminate length. Spaced a predetermined distance behind the pipe construction spread 12 is a pipe installation spread 16 which simultaneously dredges the sea bed and lays the pipeline within the dredged trench. The installation spread 16 includes a forward section having a number of pipe elevation supports 18, and cutting means 20, 22 for creating an opening in the ice, a rearward section which includes an installation vehicle 24.

In a preferred embodiment, the construction and installation spreads are immediately adjacent each other. However, it is to be understood that the construction spread 12 may precede the installation spread 16 by a substantial distance.

The construction spread 12 may span a distance of approximately 160 to 200 feet or more, depending upon the characteristics of the pipe being assembled. The installation spread 16 spans a distance of approximately one-eighth mile. The installation vehicle itself is about 120 to 160 feet or more in length depending upon the characteristics of the pipeline being laid. The weight of both the construction and installation spreads will of course vary depending upon the materials from which they are constructed, and their overall length. One skilled in the art may easily determine the materials from which spreads are to be constructed, the length of the spreads and the safety limits of the weight of the entire load which may rest on a given ice mass.

In a preferred method of operation the surface of the ice mass under which the pipeline is to be located is cleared of snow and other obstacles. Pipe segments 13 may then be disposed at various supply caches along the cleared route. The pipe construction spread 12 travels over the ice along the cleared route and joins the pipe segments to form an integral constructed pipeline 14 of indeterminate length. The constructed pipeline 14 is deposited on supports 26 which elevate the pipeline 14 a slight distance (i.e. approximately three feet) above the surface of the ice. In a preferred embodiment, the pipe construction spread 12 is propelled by acting against the constructed pipeline. Alternatively, spread 12 may be pulled in tow by a tractor (not shown) or similar means able to provide traction on the ice surface.

The installation spread 24, following immediately behind the construction spread 12, advances toward the constructed pipeline 14. The pipeline 14 is further elevated by an inclined up ramp 32 which serves as the lead component of spread 16. As ramp 32 advances, the pipeline 14 is progressively elevated and is eventually deposited upon pipe elevation supports 18 which maintain pipeline 14 at a height of approximately 20 feet above the ice surface. In one embodiment a first ice cutting means 20 travels behind up ramp 32 and beneath the elevated pipeline 14 to form two parallel grooves in the ice which fully penetrate the ice mass and are spaced apart by a distance of approximately 8 to 10 feet. A second ice cutting means 22 travels over the ice closely behind the first ice cutting means 20 and forms an additional cut, or cuts, in the ice mass which are oriented perpendicular to and run between the parallel grooves formed by cutting means 20, thus forming ice blocks 34. The ice blocks 34 thus formed are removed from the ice hole to provide a slot-like opening in the ice mass. In a preferred embodiment, the ice blocks 34 may be placed beneath the surface of the ice by ram means 23 carried on cutting means 22. Preferably, the ice blocks 34 are placed on alternating sides of the slot beneath the lip of the ice to provide added support to the ice mass.

As the installation spread 16 advances, pipeline 14, elevated by supports 18A, 18B and 18C, is directed downwardly toward the slot in the ice by down ramp 36.

The various ramps, supports and cutting means, which form a forward portion of spread 16, may be tethered to each other and towed by tractor 30 or a similar means for facilitating movement over the ice. These components move in concert with and are connected to installation vehicle 24 by cable 40. Preferably, installation vehicle 24 is self-propelled.

The advancing installation vehicle 24 includes equipment which is adapted to create a submarine trench 42 of approximately 15 feet in depth in the bed of the body of water. At the same time, vehicle 24 lays pipeline 14 within trench 42, in a manner more fully described below. Preferably, the laid pipeline 14 may be covered with the spoils of the trenching operation which are redirected to the trench through discharge pipe 126.

In a preferred embodiment the trenching and pipe laying operation is conducted during an arctic winter season when the ice mass is of sufficient thickness, such as 6 to 8 feet, to support the weight of the apparatus 10 of this invention. To extend the pipe laying season, it is sometimes possible to increase the ice mass thickness to provide a working ice surface of sufficient strength to support the apparatus 10 of this invention. Such ice thickening techniques are well known to those having ordinary skill in the art. In a preferred embodiment, the components of the pipe construction spread 12 and the installation spread 16 are supported on snow skids, if towed by another vehicle, or crawler tracks, if self-propelled. In either case, the skids or tracks are supported by the ice and typically straddle the slot formed in the ice.

The pipe construction spread 12, as illustrated in FIG. 1, comprises a plurality of environmentally controlled work stations 44 which are supported on snow skids. The work stations 44 are serially connected and aligned along the longitudinal axis of the spread 12. A pipe conveyor system (not shown) extends along the entire length of the spread. A control room 46 is located at the head of the spread and contains a diesel generator room, fuel storage facility and a control room. The design parameters for such an apparatus, which may vary for a given pipe laying run, are easily developed by one of ordinary skill in the art.

The pipeline 14 is constructed by placing a pipe segment 13 on the pipe conveyor system and aligning it with the existing pipeline or pipe segment to which it is to be joined. The pipe segments may be joined by a variety of known techniques. Preferably, however, the pipe segments are joined by automatic welding techniques which are performed within the environmentally controlled work stations 44. In a preferred embodiment it is also desirable to have one or more work stations equipped with x-ray equipment to ensure the integrity of the welded joints. Also, it is desirable to have audio and visual linkage between the work stations and the control room.

In a preferred embodiment, the construction spread 12 is propelled as a result of using the pipe conveyor system to react against the constructed pipeline thus resulting in forward movement of spread 12. This method of propulsion may be replaced or supplemented by any one of a number of propulsion means well known to those skilled in the art. For example, the construction spread 12 may be towed by a tractor (not shown) or similar means which is able to provide traction over the ice surface. The speed at which construction spread 12 travels depends on the dimensions of the pipeline being constructed and laid, and typically ranges between 1 mile per day and 3 miles per day.

As the constructed pipeline 14 leaves the construction spread 12 it is deposited on pipe supports 26 which maintain the pipeline at a height of about three feet above the ice. The supports 26 prevent the pipeline 14 from freezing to the ice surface. Supports 26 are spaced apart by approximately 40 foot intervals.

The pipeline 14 laid with the apparatus of this invention may be of any type which is typically used in arctic, submarine applications. Preferably, the pipeline has an inside diameter ranging from several inches to several feet. The wall thickness of the pipe may range from approximately one quarter inch to a few inches.

The installation spread 16 simultaneously trenches and lays the pipeline within the sea bed. This spread spans approximately one-eighth of a mile and is adapted to move at a minimum rate of between one to three miles per day. The installation spread 24 includes three components: a pipeline support system, an ice slotting and removal system, and an installation vehicle 24.

A pipeline elevation system, towed by a tractor 30, or similar means capable of operating in an arctic climate and providing traction on an iced surface, serves as the forward portion of the installation spread 16. An inclined ramp 32 is the lead element of spread 16 and travels under the constructed pipeline, thereby raising it a greater distance above the surface of the ice. Additional elevation means 18A, 18B and 18C follow behind inclined ramp 32 and are connected to ramp 32, and each other, by cables 40. As the installation spread 12 advances, the constructed pipeline 14 is further elevated and is supported by the top surface of supports 18A, 18B and 18C at a height of approximately 20 feet above the surface of the ice. A down ramp 36 is spaced behind the last support 18A and gradually directs the constructed pipeline 14 downwardly toward the surface of the ice.

Inclined ramp 32 comprises a support frame of suitable strength and design to support the weight of the constructed pipeline 14. The support frame is mounted upon snow skids which may be spaced relatively close together or, alternatively, spaced apart by approximately 8 to 10 feet so that, if necessary, the skids may straddle the slot in the ice. Typically, however, it is not necessary for the skids of ramp 32 to straddle the ice slot as ramp 32 precedes the slot. The top surface of inclined ramp 32 is typically inclined at a slight angle sufficient to gradually elevate the pipeline to the desired height. This angle is, of course, dependent upon the physical properties of the pipeline and may be easily determined by one skilled in the art. Ramp 32 may feature a groove of sufficient width to supportingly receive the constructed pipeline 14. The interior surface of the groove may be constructed from a self-lubricating polymer, or may be lined with rollers or bearings to provide the necessary low friction seating to facilitate the easy passage of pipe over the ramp. Alternatively, the surface of the ramp may be constructed without a groove and may be lined with a self-lubricating polymer or may feature bearings or rollers to decrease friction. In such case it may be advantageous to provide a guide means on the surface of ramp 32 to ensure that pipeline 14 is properly positioned.

Elevation support means 18 may comprise approximately three structures (18A, 18B and 18C) which are each spaced apart by a distance (e.g. approximately 40 to 80 feet) which will vary depending upon the characteristics of the pipeline. Preferably, structures 18A, B and C are of non-uniform height with structure 18B being the tallest and structures 18A and 18C being of a substantially equal height and slightly shorter than structure 18B. In another embodiment, structures 18A, 18B and 18C may all be of uniform height. Ultimately, structures 18A, B and C elevate pipeline 14 to a height of approximately 20 feet above the surface of the ice.

In a preferred embodiment, where structures 18A, B and C are of non-uniform height, structure 18C follows a predetermined distance behind inclined ramp 32 and has a top surface which is slightly inclined to enable the pipeline to be gradually elevated to rest on structure 18B. Structure 18B follows a predetermined distance behind structure 18C and is approximately 20 feet in height. Following behind structure 18B is structure 18A which, like structure 18C, is slightly less than 20 feet in height. Structure 18C has a top surface which slopes downwardly away from structure 18B at an angle which is opposite but approximately equal to that of structure 18A. Structures 18A, B, and C are all constructed of a support frame of sufficient strength to support the weight of the constructed pipeline. The support frames of structures 18A, 18B and 18C are each mounted upon snow skids, spaced approximately 8 to 10 feet apart which preferably are adapted to straddle the slot in the ice.

The top surfaces of structures 18A, B and C may all be constructed as described with respect to ramp 32.

A down ramp 36 follows a predetermined distance (e.g. approximately 40 to 80 feet) behind structure 18A. The top surface of ramp 36 is declined in a direction away from structure 18A at an angle sufficient to gradually direct the pipeline beneath the surface of the water. Like ramp 32, ramp 36 is constructed of a frame which is mounted upon skids spaced apart by a distance sufficient to straddle a slot cut in the ice. The top surface of ramp 36 is constructed in such a way as to facilitate the low friction passage of the constructed pipeline 14 over the top surface of the ramp, and may be constructed as described with respect to the top surface of ramp 32.

To gain access to the bed of the body of water, it is necessary to create an opening in the ice mass 11. In the present invention this is accomplished by forming a slot-like opening of indeterminate length in ice mass 11. A first cutting device 20 is located behind inclined ramp 32 and below the elevated pipeline 14. Cutting device 20 contains plural cutting means 48 which are disposed side-by-side and spaced apart by approximately 8–10 feet. Cutting device 20 forms parallel grooves in the ice of sufficient depth to fully penetrate the ice mass. The cutting means 48 may comprise conventional cutters of the type well known in the art, e.g. rotary blade saws, endless blade cutters, hydraulic saws, shaped charge explosives, laser cutters, or other means suitable for such an application. Cutting device 20 is preferably a self-propelled vehicle such as a tractor 51 or similar means which is able to provide traction over an iced surface.

Figure 4B:
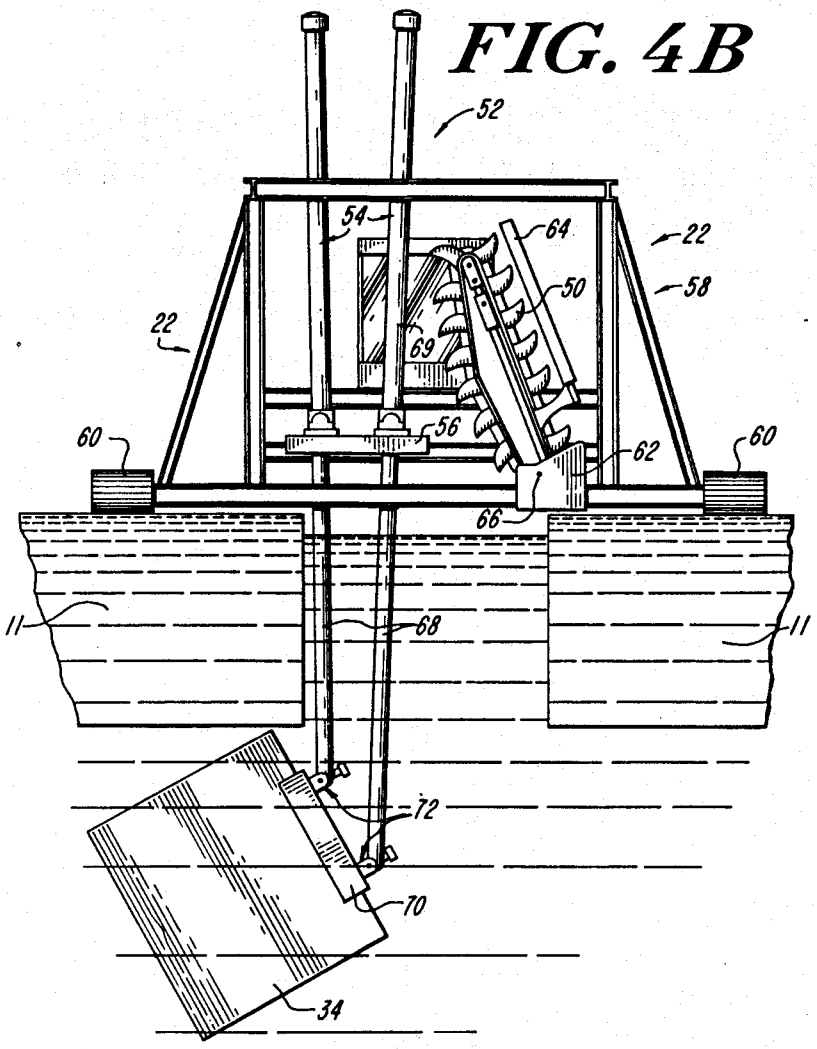
FIG. 4B is a front perspective view of the Apparatus of FIG. 4A.
Figure 4A:
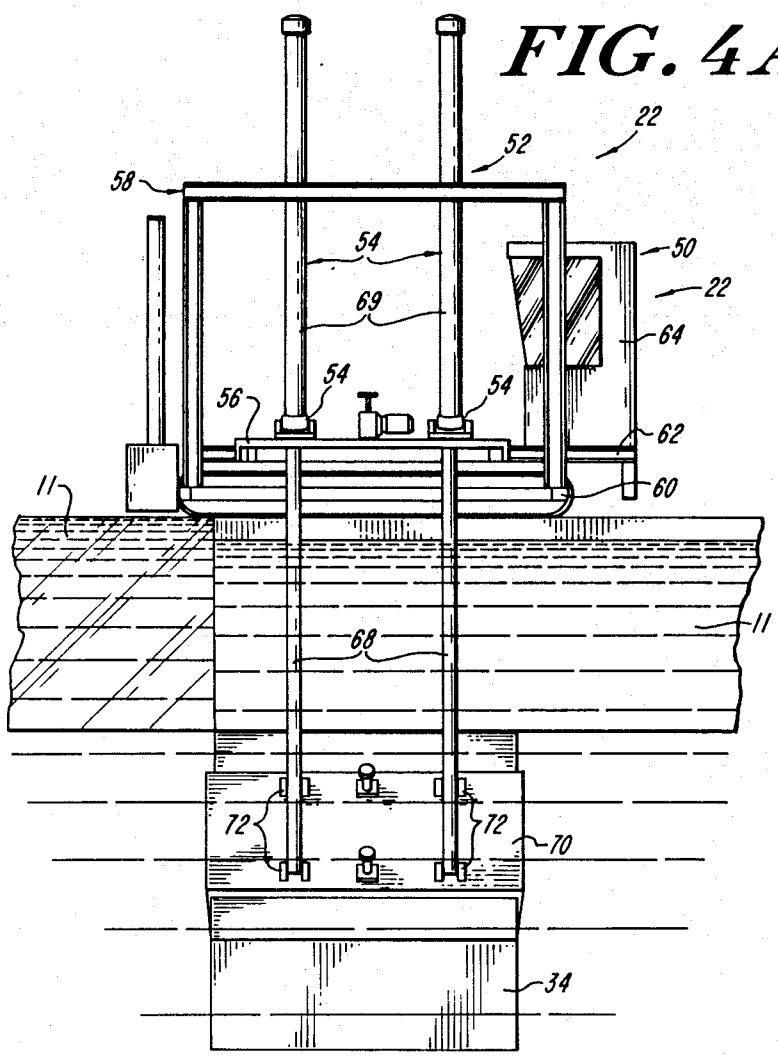
FIG. 4A is a side perspective view of the second ice cutting of this invention.

As illustrated in FIG. 1, second cutting device 22 travels a predetermined distance behind first cutting device 20 and is situated beneath elevated pipe 14. As best shown in FIGS. 4A and 4B second cutting device 22 includes cutting means 50 which is pivotally mounted on one side of cutting device 22. Cutting means 50 may comprise a cutting tool such as a saw or similar means which is able to penetrate an ice mass having a thickness of approximately 6 to 8 feet or more. Cutting means 50 is adapted to form a cut in the ice which runs perpendicular to and between the grooves formed by first cutting device 20, thus forming blocks 34. In an alternative embodiment, cutting device 22 may contain the means for both forming slots in the ice and forming ice blocks. It is also understood that cutting means 50 may comprise any of the various devices described above with respect to first cutting means 48.

After cutting an ice block from the ice, ram means 52, which may form part of second cutting device 22, grips the cut ice block 34 and disposes it under the surface of the water beneath the lip of the ice mass. Preferably, the cut ice blocks 34 are disposed on alternating sides of the ice slot.

As is best shown in FIGS. 4A and 4B, second ice cutting device 22 comprises a frame-like support structure 58, formed of a strong, light weight material mounted upon crawler tracks 60. Alternatively, support structure 58 may be mounted upon snow skids. As illustrated in FIG. 4A, cutting means 50 utilizes a cutting tool such as a saw or or other such tool, which is pivotally mounted to a flange 62 appended to one side of support structure 58. The cutting means 50 is partially shielded by a protective plate 64 mounted above the cutting means. As illustrated in FIG. 4B, cutting means 50 is preferably mounted at the forward end of the cutting device 22. Cutting device 22 is oriented such that the cutting means 50 is able to form a cut in the ice which is perpendicular to and runs between the grooves cut by cutting device 20. Upon being activated, cutting means 50 will pivot downwardly about point 66 to penetrate the ice thus forming an ice block 34.

In another embodiment, the cutting means 50 may include twin saws, or similar cutting tools which are spaced apart by approximately 8–10 feet. Such an arrangement may increase the cutting efficiency of cutting device 22.

Referring to FIGS. 4A and 4B, a preferred embodiment of cutting device 22 also includes ram means 52 for grasping ice blocks 34 and disposing the blocks beneath the surface of the ice on alternating sides of the slot in the ice. Ram means 52 is centrally located on cutting device 22 and is mounted on a cross bar structure 56 which enables the ram means 52 to be suspended over the slot to be formed in the ice. Ram means 52 includes approximately four telescopingly extensible arms 54 which are each mounted in the vicinity of one of the corners of a generally square flange 56. Extensible telescoping arms 68 are received in sleeves 69 such that arms 68 are able to extend from sleeves 69, downwardly beneath the surface of the water. The lower ends of each of arms 68 are pivotally attached at point 72 to a gripping means 70. Gripping means 70 is adapted to securely grasp a cut ice block once it has been cut. After the ice block has been firmly grasped, arms 68 extend from sleeves 69 and force the ice block downwardly beneath the surface of the water as shown in FIG. 4A. When arms 68 are fully extended the ice block is pivoted (either clockwise or counterclockwise), as shown in FIG. 4B, to place the ice block beneath the surface of the ice. After the ice block is properly located beneath the surface of the ice, the grasping means is released and arms 68 are retrieved. The exact design of ram means 52 may vary depending upon the goals of a particular pipelaying operation. One skilled in the art may easily choose a design for ram means 52 which will suit the objectives of a particular operation.

Figure 5:
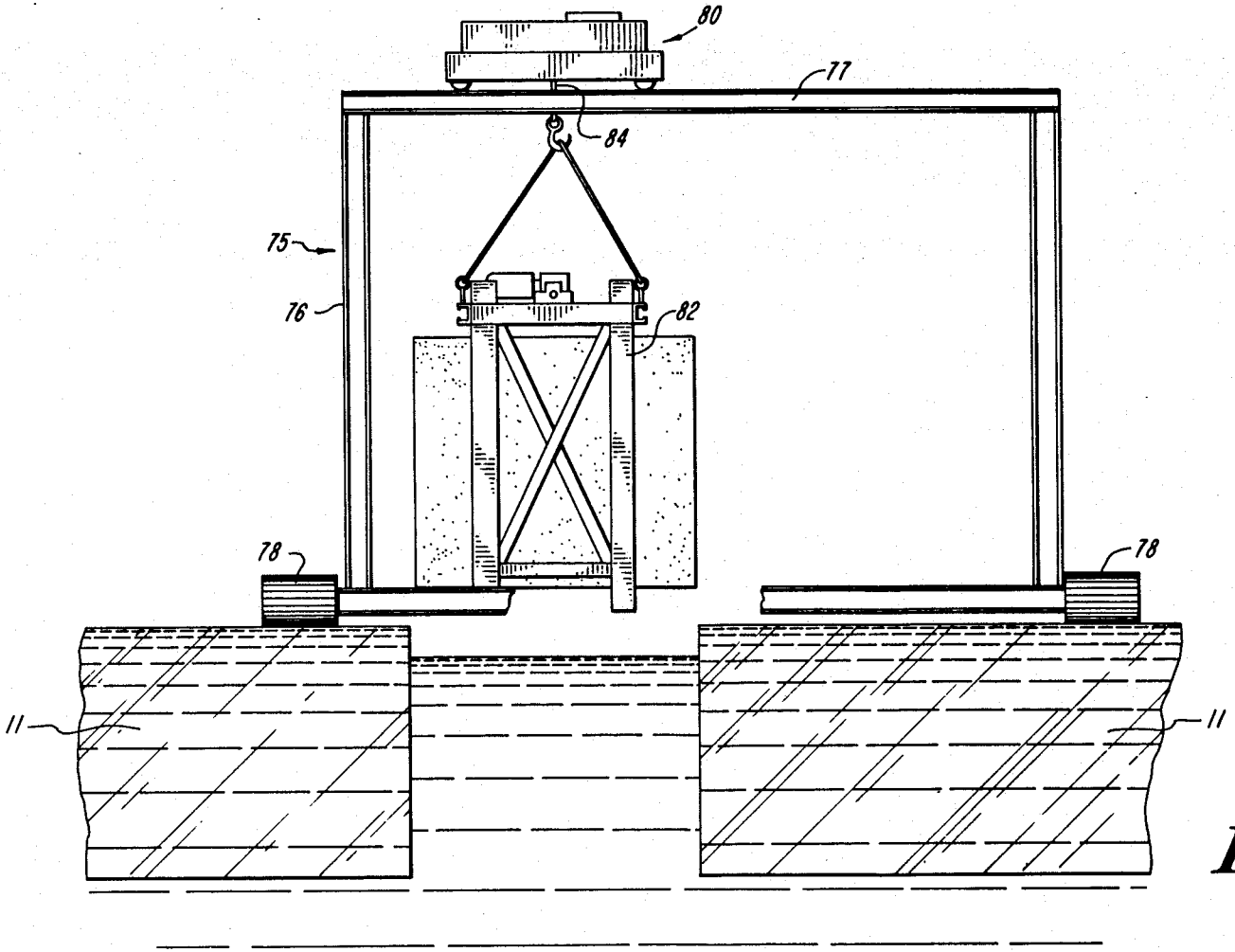
FIG. 5 front perspective view of the ice block removal device of this invention.

In a preferred embodiment of the invention a block removal device 73, for example a gantry crane 75 mounted upon snow skids as shown in FIGS. 1 and 5, is included as part of the installation spread 16 for removing selected ice blocks from within the ice slot. Ice blocks removed in this manner may be placed on the surface of the ice for subsequent replacement within the slot to add additional reinforcement to the ice mass and to facilitate quick mending of the ice surface. Preferably, block removal device 73 is located between elevation supports 18A and 18B and is mounted upon snow skids which straddle the ice slot. Further, removal device 73 is preferably connected by cable to the support structures 18 and moves in concert with these components as they are towed by tractor 30. In a preferred embodiment, every tenth block is removed by device 73 for replacement in the slot. It is understood, however, that in the practice of the present invention the ice blocks selected to be removed may be other than every tenth block.

Although block removal device 73 may comprise virtually any suitable crane-like structure, a gantry crane 75 such as that shown in FIG. 5 is preferred. Gantry crane 75 comprises a rectangular support frame 76, as is well known in the art. In an alternative embodiment the gantry crane 75 is self propelled and traverses the ice on crawler tracks 78 which straddle the slot in the ice.

Suspended from a top cross-bar 77 of rectangular frame 76 is a crane means 80 for raising and lowering the ice blocks. Secured to the lower portion of the crane means 80 is a block receiving frame 82 which securely holds the ice blocks to be removed. The crane means 80 mounted upon the top cross-bar 77 of frame 76 includes an extensible cable 84 for raising and lowering the block. Crane means 80 is adapted to move horizontally across the top cross-bar 77 of frame 76 to facilitate placement of the ice block on the surface of the ice mass for subsequent replacement within the ice slot. Crane means 80 is powered by a motor capable of lifting the ice blocks which are to be removed from the slot.

The installation vehicle 24 follows behind the pipe support structures and the ice cutting equipment as shown in FIG. 1. Platform 24 comprises two primary components—a support platform 86 and a dredging means 88.

Figure 2A:
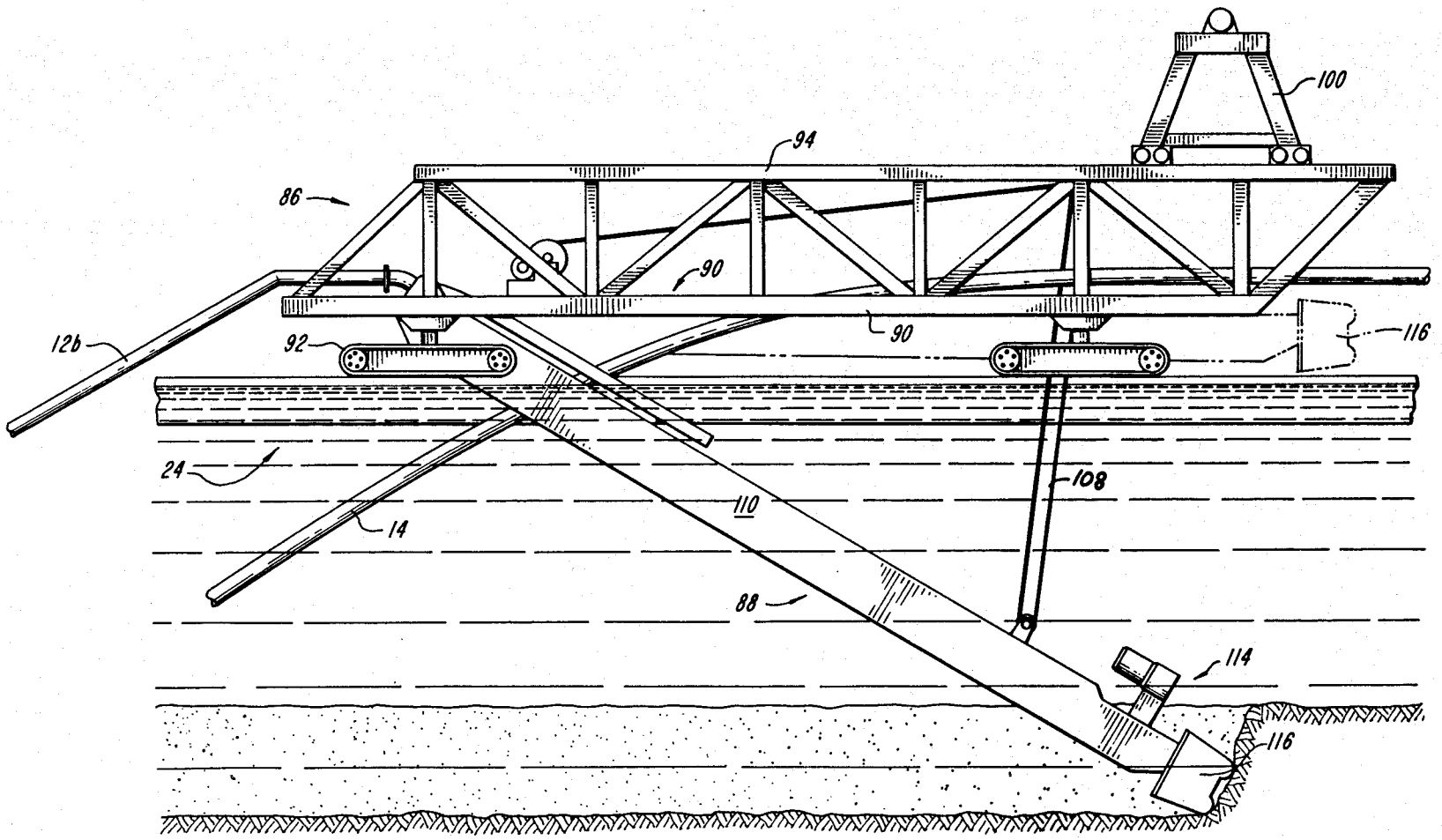
FIG. 2A is a side perspective view of the installation vehicle of FIG. 1B.
Figure 2B:
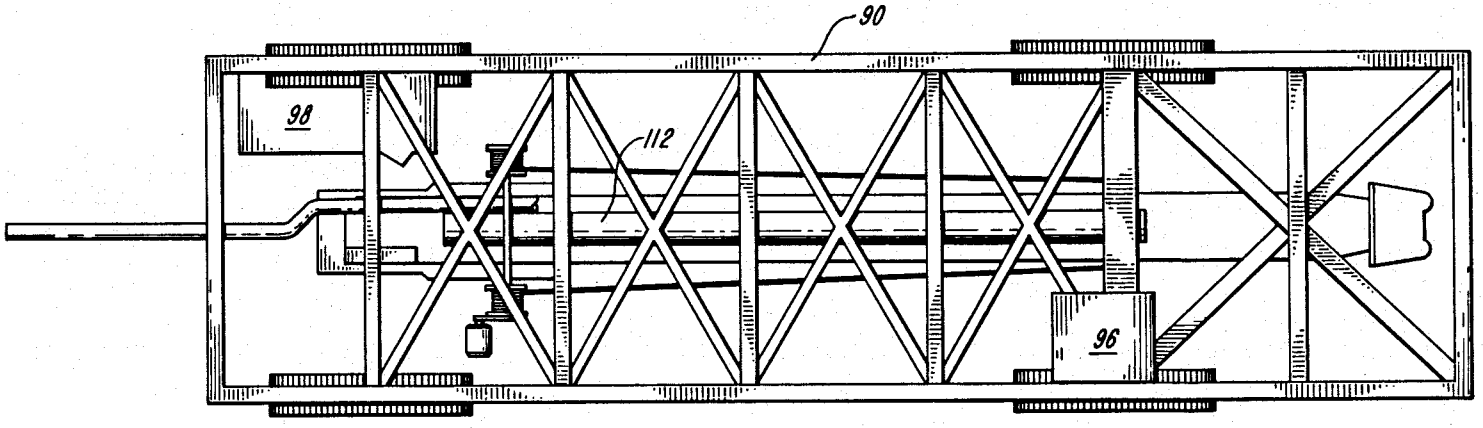
FIG. 2B is a top view of the apparatus of FIG. 2A.
Figure 2C:
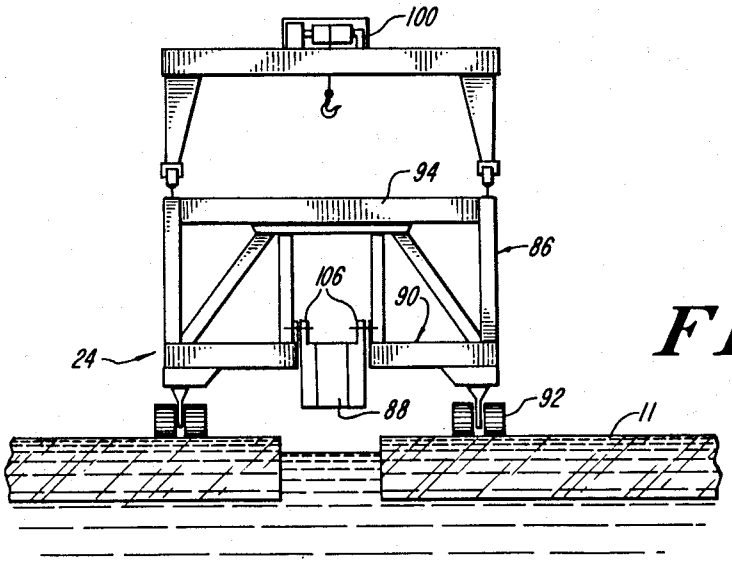
FIG. 2C is a rear view of the apparatus of FIG. 2A.
Figure 3:
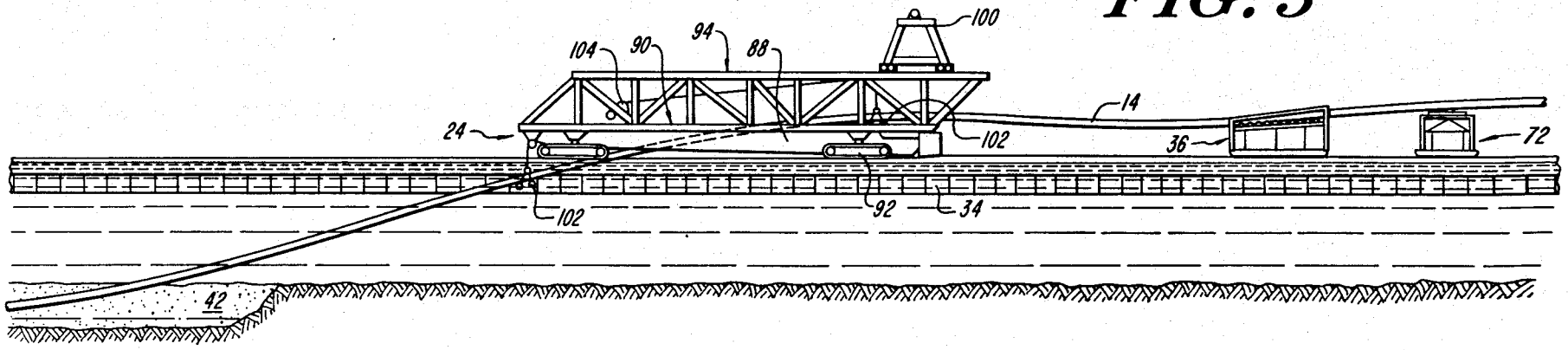
FIG. 3 is a side perspective view of the installation vehicle of FIG. 1B, depicting the dredging assembly in an elevated position.

Referring to FIGS. 2A, 2B, 2C and 3, support platform 86 comprises a high strength, light weight frame 90, the design of which may be easily developed by one having ordinary skill in the art. Frame 90 is mounted upon crawler tracks 92. The top deck 94 of platform 86 includes control rooms 96 and 98, and service crane means 100. Dredging vehicle 24 is self-propelled upon crawler tracks 92 and receives power from a remote source (not shown) which travels alongside vehicle 24. As best shown in FIG. 3, support platform 86 features at least one guide means 102, which is height-adjustable through pulley system 104, for providing guiding support for pipeline 14 in both submerged and surface positions.

Appended from platform 86, and oriented along the longitudinal axis of platform 86, is dredging assembly means 88 which is operably disposed through the slot in the ice. Dredging assembly 88 is preferably pivotally attached to the rear end of the platform 86 at points 106. As such, the dredging assembly may be raised to an inoperative surface position or lowered to a operative submerged position. To aid in the raising and lowering of dredging assembly 88, and to provide additional stability, the support platform 86 is equipped with an actuable arm 108 which is pivotally connected to and extends between an intermediate portion of the dredging assembly 88 and the support platform 86.

Dredging assembly 88 comprises a dredging support ladder 110, one end of which is pivotally secured to a rear end of support platform 86 at points 106 as noted above. Ladder 110 extends forwardly from its point of attachment on platform 86, and is pivotable between an inoperative surface position and operative submerged position. In the surface position (shown in phantom in FIG. 2A) the ladder 110 is nested just below the lower deck 90 of platform 86. In such a position ladder 110 is substantially horizontally oriented along the longitudinal axis of platform 86 and is disposed above the slot in the ice. In the operative position the ladder 110 is disposed at a slight angle with the lower deck 90 and extends downwardly through the slot in the ice to the sea bed. An actuable arm 108 facilitates the lowering of ladder 110 and also provides additional support to the ladder during trenching operations.

Figure 6:
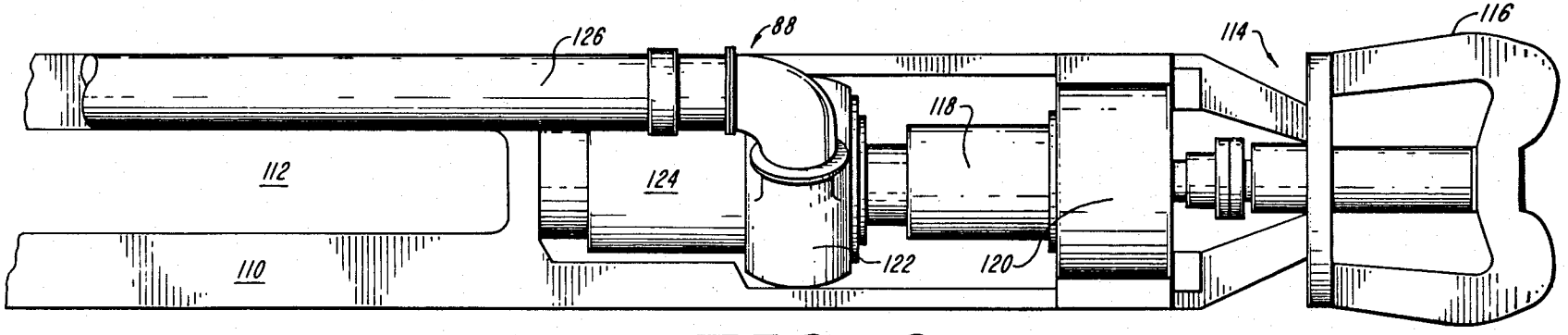
FIG. 6 is a detailed perspective view of the dredging ladder and dredging means of this invention.

Dredging ladder 110 is preferably constructed of a strong, light weight material such as alloys, composites and advanced polymers. It is expected that ladder 110 should be of sufficient strength to withstand the stresses associated with dredging from a moving surface vehicle in a corrosive arctic environment. The dredging ladder 110 may be described as an elongate member having a length sufficient to extend from platform 86 to the sea bed. Although its length will vary with particular applications, the length of ladder 110 is generally in the range of 110 to 150 feet. The width of ladder 110 must, of course, be small enough to enable it to fit within an 8 to 10 foot wide ice slot in the ice. In addition, as best shown in FIG. 6, ladder 110 features a central, elongate slot 112, the dimensions of which will vary depending upon the dimensions and physical properties, including the bend radius, of the pipeline being laid. In any event, the slot 112 should be of such size as to enable the pipeline to be easily threaded through the slot, while at the same time provide lateral and vertical support to the pipeline. One skilled in the art may easily determine the proper dimensions and placement of slot 112 for a given pipelaying operation.

Slot means 112 preferably is positioned so as to allow a submerged component of the pipeline to pass through the slot means 112 such that the slot provides support to the submerged component of the pipeline at a location between the midpoint of the submerged component and the surface of the water.

As illustrated in FIGS. 2A and 6, the forward end of ladder 110 houses a dredging means 114 which creates the trench within the sea bed. Dredging means 114 includes a cutter suction head 116, a cutter motor 118, reduction gear 120, dredging pump 122, pump motor 124 and a discharge pipe 126.

In a preferred embodiment the dredging operation is accomplished using a cutter suction head 116 having a generally circular shape, with a diameter of approximately 10 feet and sufficient power to create a trench of up to 15 feet in depth. It is believed that a wide variety of cutter suction heads may be used in the practice of the present invention. Preferably the cutter suction head features interchangeable teeth to accommodate dredging operations in a variety of soils. The cutter head 116 preferably is powered by a 1000 horsepower motor 118 which enables the cutter head to break up the seabed to form the trench 42. Through the action of pump 122, which is approximately 30×30 inches, and is powered by a 1000 horsepower motor, the dredging spoils are pumped into discharge pipe 126. Discharge pipe 126 is mounted to the side of ladder 110 and extends upwardly with the ladder to the rear of platform 86. After reaching the platform 86, pipe 126 is redirected downwardly into the water to facilitate the backfilling of the trench after the pipe has been laid, as shown in FIG. 1.

To commence the trenching and pipe laying operation of this invention, the ice over the area in which the pipeline is to be laid is cleared of snow and other obstacles, and the pipeline is constructed as described above. As the installation spread 16 advances toward the constructed pipeline 14, the pipeline is raised on supports 18 to a height of approximately 20 feet above the ice surface. Ice cutting device 20, operates beneath the elevated pipe to create a slot-like opening of approximately 8 to 10 feet in width. A second cutting device 22 cuts blocks 34 in the ice and, through the action of ram means 52, disposes the blocks under the surface of the ice. Subsequently the pipe 14 is directed downwardly toward the slot cut in the ice.

With dredging assembly 88 and guide 102 in the raised position, pipeline 14 is threaded first through guide 102 and then through slot 112 of dredging ladder 110. The guide 102 and dredging assembly 88 are then lowered through the slot in the ice (along with the pipeline) into the water. After cutter suction head 116 contacts the seabed, dredging is commenced and trench 42 is created. Installation vehicle 24 advances along the predetermined path while extending the length of trench 42. As the vehicle 24 advances it gathers additional length of pipeline 14 and simultaneously deposits the pipeline within the trench. After the pipeline 14 is laid it is covered with the spoils of the dredging operation which issue from the discharge pipe 126. The trenching and laying operation continues in this manner until a sufficient length of pipeline is laid.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. Apparatus for simultaneously trenching and laying submarine pipeline within the bed of a body of water covered with an ice mass, comprising a vehicle capable of advancing over an ice mass in the direction of a pre-assembled pipeline to be laid;

means for creating a slot-like opening of indeterminate length in the ice mass, ahead of the advancing vehicle;

a submersible dredging means for excavating a submarine trench in the bed of the body of water, into which the pipeline is to be laid;

a support means for carrying and deploying the dredging means, the support means having a longitudinally aligned slot, and having a first end pivotally connected to the vehicle and a second, submersible end which carries the dredging means, the support means being operably disposed through the opening in the ice mass such that the dredging means is able to excavate a subterranean trench to a predetermined depth;

means pivotally secured to and extending between the vehicle and an intermediate portion of the support means for raising and lowering the support; and pipeline means having a surface component, a submerged component and an entrenched component, the submerged component intersecting with the support means through the longitudinally disposed slot, such that the slot provides support to the submerged component of the pipeline at a location between the midpoint of the submerged component and the surface of the water.

2. Apparatus of claim 1 further comprising a means for constructing the pipeline, the means including a vehicle capable of movement over the ice mass and having a plurality of enclosed stations for joining multiple pipe segments to form a pipeline of indeterminate length.

3. Apparatus of claim 2 wherein the pipeline construction means is disposed ahead of the vehicle.

4. Apparatus of claim 1 further comprising a plurality of elevation supports disposed between the pipeline construction means and the vehicle, the supports being adapted to raise the surface component of the pipeline a predetermined distance above the surface of the ice mass.

5. Apparatus of claim 1 wherein the vehicle is supported on and is propelled over the ice mass by tracks which grip and provide traction on the ice mass.

6. Apparatus of claim 5 wherein said vehicle has at least two said tracks, each being disposed on opposite sides of the opening in the ice such that the vehicle straddles the opening.

7. Apparatus of claim 6 wherein the vehicle receives power from a remote power source.

8. The apparatus of claim 1 wherein said dredging means comprises a cutter suction head.

9. The apparatus of claim 8 wherein a pump means provides the suction capability for the dredging means.

10. The apparatus of claim 9 wherein the dredging means is equipped with a discharge pipe for removing spoils of the dredging operation and for redirecting the dredqing spoils over the pipeline laid in the trench.

11. Apparatus of claim 10 wherein the dredging means is generally circular in shape and has a diameter of approximately 10 feet.

12. Apparatus of claim 11 wherein the dredging means is capable of creating a trench having a depth of approximately 15 feet.

13. Apparatus of claim 12 wherein said support is approximately 140 feet in length.

14. Apparatus of claim 1 wherein said means for creating opening in the ice comprises a first cutting device having plural cutting means for cutting parallel grooves in the ice.

15. Apparatus of claim 14 wherein means for creating an opening in the ice further includes a second cutting device having cutting means which cut perpendicular to and between said parallel grooves to form removable ice blocks.

16. Apparatus of claim 15 wherein said second cutting device includes at least one ram means adapted to grip an ice block and locate it below the surface of the ice on either side of the opening in the ice.

17. Apparatus of claim 16 wherein said ram means device disposes the cut blocks on alternating sides of the opening in the ice.

18. Apparatus of claim 17 further including a crane means for removing ice of blocks at predetermined intervals for replacement within the opening in the ice at a location behind the vehicle.

19. Apparatus of claim 4 wherein said elevating supports raise the surface component of the pipeline above the surface of the ice to a height of approximately 20 feet.

20. Apparatus of claim 19 further including means for propelling said elevating supports over the ice mass in the direction of the assembled pipeline.

21. Apparatus of claim 1 wherein said and pipeline construction means receives power from a remote power source.

22. Apparatus for simultaneously trenching and laying submarine pipeline within the bed of a body of water covered with an ice mass, comprising a first vehicle capable of movement over an ice mass, having means for joining a plurality of pipe segments to form an integral pipeline of indeterminate length;

a second vehicle spaced a predetermined distance behind the first vehicle, and capable of movement over an ice mass in the direction of the constructed pipeline;

a means for creating a slot-like opening of indeterminate length in the ice mass, ahead of the advancing second vehicle;

a submersible dredging means for excavating a submarine trench in the bed of the body of water, into which the pipeline is to be laid;

a support means for carrying and deploying the dredging means, the support means having a longitudinally aligned slot, and having a first end pivotally connected to the vehicle and a second, submersible end which carries the dredging means, the support means being operably disposed through the opening in the ice mass such that the dredging means is able to excavate a subterranean trench to a predetermined depth;

means pivotally secured to and extending between the second vehicle and an intermediate portion of the support means for raising and lowering the support; and pipeline means having a surface component, a submerged component and an entrenched component, the submerged component intersecting with the support means through the longitudinally disposed slot, such that the slot provides support to the submerged component of the pipeline at a location between the midpoint of the submerged component and the surface of the water.

23. Apparatus for supporting the simultaneous trenching and laying of submarine pipeline within the bed of a body of water covered with an ice mass, comprising a vehicle capable of movement over an ice mass and having appended thereto an elongate dredging support means able to be operably disposed beneath the surface of the water through a slot in the ice, the dredging support means being adapted for carrying and supporting a dredging means and having a longitudinally aligned slot for receiving and supporting a submerged component of a pipeline to be laid within a submarine trench.

24. A method for simultaneously trenching and laying submarine pipe within the bed of a body of water covered with an ice mass, comprising the steps providing a vehicle capable of forward movement;

cutting an opening in the ice mass ahead of the advancing vehicle;

providing a submersible dredging means operably disposed through the opening in the ice mass for excavating a submarine trench, the dredging means being secured to a first end of an elongate support member, the second end of which support member is pivotally connected to the vehicle;

advancing the vehicle, with the dredging means operably disposed, to form a submarine trench, and simultaneously laying a preconstructed pipeline of indefinite length from a surface position to a position within the trench, the pipeline intersecting and being supported by a component of the support member at a location between the midpoint of a submerged segment of the pipeline and the surface of the water, and the pipeline being deployed within the trench as a result of the forward movement of the vehicle, and;

burying the pipeline within the submarine trench.

25. Apparatus for simultaneously trenching and laying submarine pipeline within the bed of a body of water covered with an ice mass having a slot-like opening of indeterminate length, comprising a vehicle capable of advancing over an ice mass in the direction of a pre-assembled pipeline to be laid;

a submersible dredging means for excavating a submarine trench in the bed of the body of water, into which the pipeline is to be laid;

a support means for carrying and deploying the dredging means, the support means having a first end pivotally connected to the vehicle and a second, submersible end which carries the dredging means, the support means being operably disposed through the opening in the ice mass such that the dredging means is able to excavate a subterranean trench to a predetermined depth;

means pivotally secured to and extending between the vehicle and an intermediate portion of the support means for raising and lowering the support; and pipeline means having a surface component, a submerged component and an entrenched component, the submerged component intersecting with the support means and being supported by a component of said support means such that the submerged component of the pipeline is supported at a location between the midpoint of the submerged component and the surface of the water.

* * * * *